US011117764B2

(12) United States Patent
Herrmann et al.

(10) Patent No.: US 11,117,764 B2
(45) Date of Patent: Sep. 14, 2021

(54) INNER PLENUM VACUUM ROLLER SYSTEM FOR A CUT SHEET PRINTER DRYER TRANSPORT

(71) Applicant: Xerox Corporation, Norwalk, CT (US)

(72) Inventors: Douglas K. Herrmann, Webster, NY (US); Seemit Praharaj, Webster, NY (US); Michael J. Levy, Webster, NY (US); Jason M. Lefevre, Penfield, NY (US); Paul McConville, Webster, NY (US); Chu-Heng Liu, Penfield, NY (US); Linn C. Hoover, Webster, NY (US); David A. VanKouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/679,215

(22) Filed: Nov. 10, 2019

(65) Prior Publication Data

US 2021/0138802 A1 May 13, 2021

(51) Int. Cl.
*B41J 11/00* (2006.01)
*B65H 5/22* (2006.01)

(52) U.S. Cl.
CPC ..... *B65H 5/226* (2013.01); *B41J 11/002* (2013.01); *B41J 11/0085* (2013.01)

(58) Field of Classification Search
CPC ..... B41J 13/226; B65H 5/226
See application file for complete search history.

(56) References Cited

U.S. PATENT DOCUMENTS

| | | | | |
|---|---|---|---|---|
| 5,031,002 | A * | 7/1991 | Yaguchi | G03G 15/657 399/400 |
| 6,398,208 | B1 | 6/2002 | Yang et al. | |
| 9,064,813 | B2 | 6/2015 | Kanakasabapathy et al. | |
| 9,492,891 | B2 | 11/2016 | Herrmann | |
| 9,796,546 | B1 | 10/2017 | LeFevre et al. | |
| 9,944,094 | B1 | 4/2018 | Herrmann et al. | |
| 10,102,456 | B2 | 10/2018 | Herrmann | |
| 10,358,307 | B1 | 7/2019 | Liu et al. | |
| 10,427,421 | B1 | 10/2019 | LeFevre et al. | |
| 2009/0121423 | A1* | 5/2009 | Nakamura | B65H 16/028 271/275 |
| 2010/0259590 | A1* | 10/2010 | DeGruchy | B41J 11/0085 347/104 |

(Continued)

OTHER PUBLICATIONS

Xerox Brenva HD Production Inkjet Press, 2018, Xerox Corporation.

(Continued)

*Primary Examiner* — Shelby L Fidler
(74) *Attorney, Agent, or Firm* — Ortiz & Lopez, PLLC; Luis M. Ortiz; Kermit D. Lopez

(57) ABSTRACT

A vacuum roller system and a method of operating the vacuum roller system can include a group of vacuum rollers operable to move a sheet of media through a dryer. The vacuum rollers do not require a vacuum to be drawn between the vacuum rollers. Each vacuum roller can include a plenum operable to direct the vacuum to a top portion of the vacuum roller to drive the sheet of media from one roller to the next roller. The plenum can engage vacuum holes in a rotating vacuum roller when the vacuum holes in the vacuum roller are aligned with the plenum.

17 Claims, 11 Drawing Sheets

(56) References Cited

U.S. PATENT DOCUMENTS

| | | | | |
|---|---|---|---|---|
| 2017/0020741 | A1* | 1/2017 | Ingole | B65G 39/02 |
| 2018/0081302 | A1 | 3/2018 | Wu et al. | |
| 2018/0136888 | A1 | 5/2018 | Robinson et al. | |

OTHER PUBLICATIONS

SheetFeeder BV, Jet speed productivity, 2018, Tecnau.
Xerox Brenva HD, Production Injet Press Overview, 2016, Xerox Corporation.

* cited by examiner

INNER PLENUM VACUUM ROLLER SYSTEM FOR A CUT SHEET PRINTER DRYER TRANSPORT

TECHNICAL FIELD

Embodiments are related to printing systems. Embodiments also relate to transports, transport belts, radiant dryers and other components utilized in printing systems. Embodiments further relate to an inner plenum vacuum roller system for use with a cut sheet printer dryer transport in a printing system. Embodiments further relate to a vacuum roller system and method of operating the vacuum roller system.

BACKGROUND

Printing systems known in the document reproduction arts can apply a marking material (e.g., ink or toner), onto a substrate such as a sheet of media (e.g., paper, a textile, metal, plastic, etc.) and objects having a non-negligible depth such as a coffee cup, bottle, and the like.

A printing system (which can also referred to simply as a printer) can perform printing of an image or the like on sheets of paper, for example, by transporting a sheet of paper (or other media substrates), which is an example of a medium, up to a position of a printing section using a transport roller, and an endless form transport belt, which can rotate while coming into contact with the sheet of paper, and discharging ink, which is an example of a liquid, toward the sheet of paper from a liquid discharging head.

Such printing systems typically utilize an ink jet dryer such as a radiant dryer and a vacuum belt system to transport ink jet media through the radiant dryer. FIG. 1 illustrates an image of a prior art vacuum belt transport system 112 utilized in some printing systems. As shown in FIG. 1, the vacuum belt transport system 112 can include a belt 114, a belt 116, a belt, 118, a belt 120, and a belt 122, which each include belt holes. FIG. 2 illustrates an image depicting a close-up view of a prior art holes/plenum configuration utilized in some printing systems. FIG. 3 illustrates an image depicting a vacuum hole defects caused by prolonged contact of media to a transport belt during drying in some printing systems. Note that in FIGS. 1-3 identical or similar parts are indicated by identical or similar reference numerals.

Because the vacuum belt transport system 112 and the sheet of media transit the dryer system at the same speed, there is no relative motion between the belt and the media. The belt holes and each of the belts 114, 116, 118, 120, 122 have different properties and during the drying phase this can manifest in differential drying of the ink and image defects.

Current ink sets are designed to print black, cyan, magenta, and yellow. The current set of inks (Cyan, Magenta, Yellow & Black) that have been selected for use in some printing systems may suffer from differential drying when being transported through the radiant dryer. Due to the fact that the sheets of media enter and transit the dryer when the image is not dry, nip rollers may not be used in such situations.

This has led to the use of vacuum belt systems that create drive on the bottom of the sheet of media. Such vacuum belt systems may include a belt that creates this drive through the use of a plenum and holes in each belt that transfer the vacuum force to the backside of the media.

While this can facilitate the necessary drive, it can leave the media in direct contact with a specific region of the belt for the entire time it transits through the dryer. The media does not move relative to the belt during the drying process. This can lead to image defects resulting from the differences in temperature and the material properties of the belt and the holes in the belt. These differences in temperature can lead to changes in the rate of drying which can impact the image quality.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved printing system.

It is another aspect of the disclosed embodiments to provide for an inner plenum vacuum roller system for use with a cut sheet printer dryer transport in a printing system.

It is a further aspect of the disclosed embodiments to provide for an improved vacuum roller system and a method of operating the vacuum roller system.

The aforementioned aspects and other objectives and advantages can now be achieved as described herein. In an embodiment, a vacuum roller system can include a plurality of vacuum rollers that moves a sheet of media through a dryer, wherein the vacuum rollers in the plurality of vacuum rollers do not require a vacuum to be drawn between the vacuum rollers. Each vacuum roller among the plurality of vacuum rollers can include a plenum operable to direct the vacuum to a top portion of the vacuum roller to drive the sheet of media from one roller to a next roller among the plurality of vacuum rollers, wherein the plenum engages vacuum holes in a rotating vacuum roller when the vacuum holes in the vacuum roller are aligned with the plenum.

In an embodiment, the dryer can include a downstream dryer of a printing system.

In an embodiment, a single drive system can rotate the vacuum rollers about a fixed stationary plenum.

In an embodiment, the single drive system can include a timing belt.

In an embodiment, the plenum can be adjustable by rotation to allow for variations of an application of the vacuum to the sheet.

In an embodiment, an angle of the plenum can be adjustable to move an acquisition point of the vacuum to the sheet of media.

In an embodiment, the vacuum roller system can further include an operator side vacuum baffle roller system subassembly that includes the plurality of vacuum rollers.

In an embodiment, each vacuum roller can include an inner stationary vacuum plenum system and a first shaft end portion and a second shaft end portion.

In an embodiment, each of the first and second shaft end portions of the each vacuum roller can include a vacuum shaft, a bushing, and a flat portion, wherein the vacuum opening is located with respect to the plenum through a center of the vacuum shaft, the bushing is operable to allow the vacuum roller to rotate around the vacuum shaft, and the flat portion is used to prevent the vacuum shaft from rotating, and for controlling an optional rotation of an inner vacuum plenum.

In an embodiment, the vacuum roller system can further include at least one tiltable baffle located with each vacuum roller to adjust for down curl and differing media motion profiles.

In an embodiment, an angle of the plenum can be adjustable based on printing job data including at least one of: a weight of the sheet of media, a size of the sheet of media and a coating, and the printing job data can be entered by an operator of the printing system or can comprise printing job data previously saved in the printing system.

In another embodiment, a vacuum roller system can include at least one processor; and a non-transitory computer-usable medium embodying computer program code, the computer-usable medium capable of communicating with the at least one processor. The computer program code can comprise instructions executable by the at least one processor and configured for: moving a sheet of media through a dryer with a plurality of vacuum rollers, wherein the vacuum rollers in the plurality of vacuum rollers do not require a vacuum to be drawn between the vacuum rollers; and directing the vacuum to a top portion of the vacuum roller with a plenum to drive the sheet of media from one roller to a next roller among the plurality of vacuum rollers, wherein each vacuum roller among the plurality of vacuum rollers comprises a plenum operable to direct the vacuum to the top portion of the vacuum roller to drive the sheet of media from the one roller to the next roller among the plurality of vacuum rollers, wherein the plenum engages vacuum holes in a rotating vacuum roller when the vacuum holes in the vacuum roller are aligned with the plenum.

In another embodiment, a method of operating a vacuum roller system, can include moving a sheet of media through a dryer with a plurality of vacuum rollers, wherein the vacuum rollers in the plurality of vacuum rollers do not require a vacuum to be drawn between the vacuum rollers; and directing the vacuum to a top portion of the vacuum roller with a plenum to drive the sheet of media from one roller to a next roller among the plurality of vacuum rollers, wherein each vacuum roller among the plurality of vacuum rollers comprises a plenum operable to direct the vacuum to the top portion of the vacuum roller to drive the sheet of media from the one roller to the next roller among the plurality of vacuum rollers, wherein the plenum engages vacuum holes in a rotating vacuum roller when the vacuum holes in the vacuum roller are aligned with the plenum.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
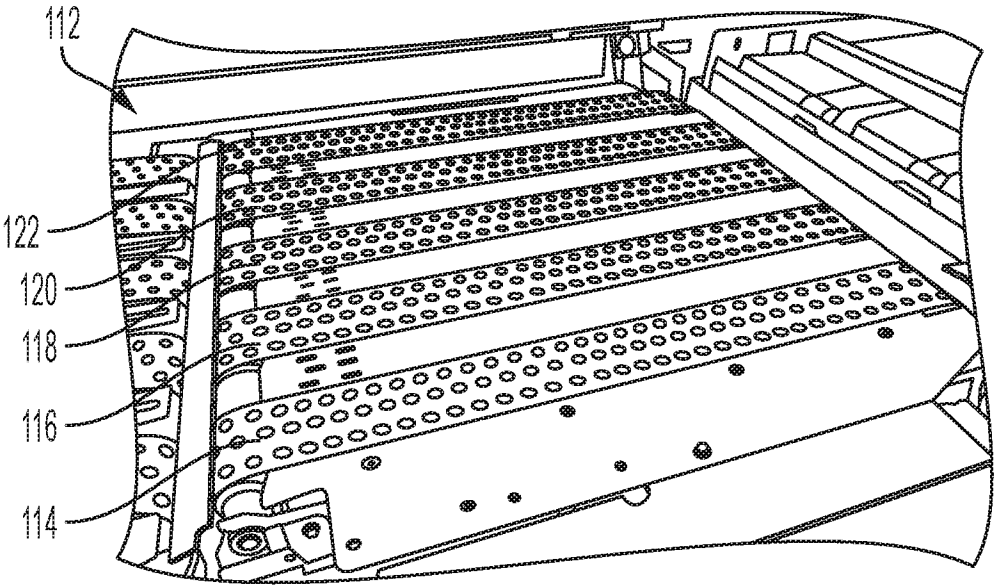
FIG. 1 PRIOR ART
FIG. 1 illustrates an image of a prior art vacuum belt transport system utilized in some printing systems.
Figure 2:
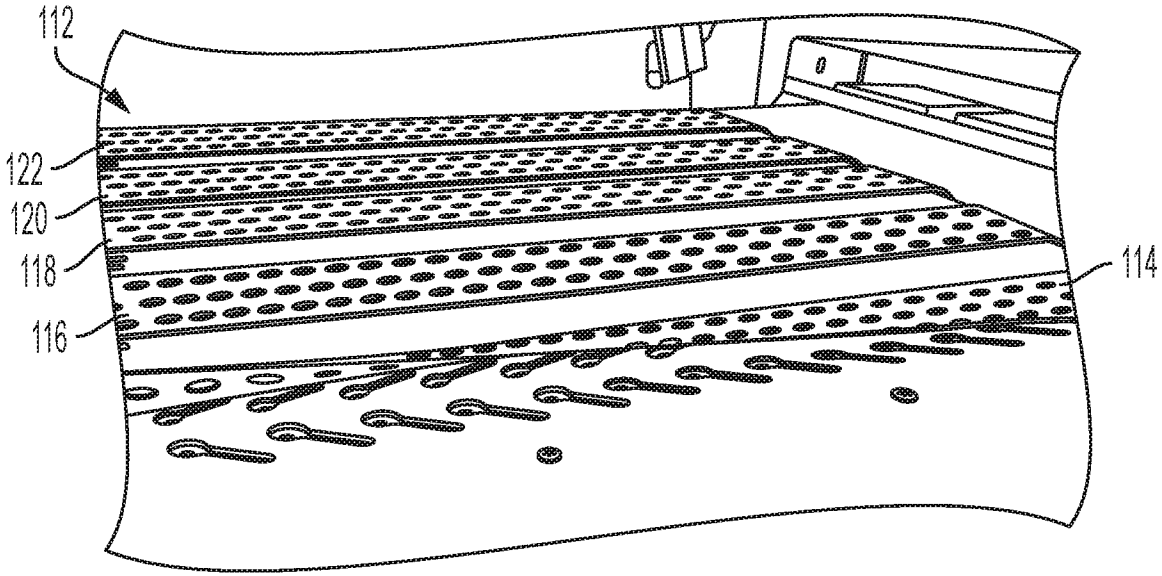
FIG. 2 PRIOR ART
FIG. 2 illustrates an image depicting a close-up view of a prior art holes/plenum configuration utilized in some printing systems.
Figure 3:
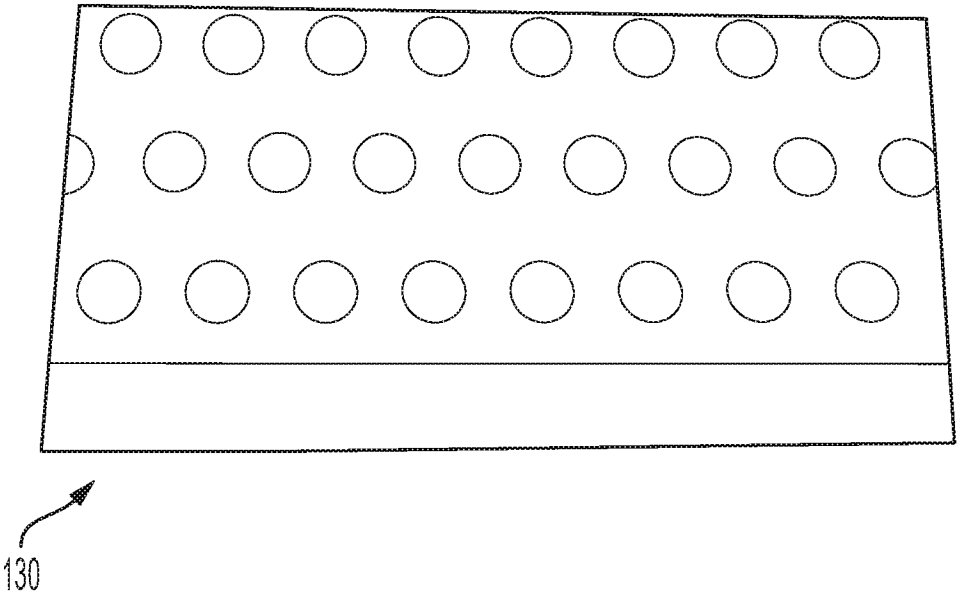
FIG. 3 PRIOR ART
FIG. 3 illustrates an image depicting a vacuum hole defect caused by prolonged contact of media to a transport belt during drying in some printing systems.

The particular values and configurations discussed in these non-limiting examples can be varied and are cited merely to illustrate one or more embodiments and are not intended to limit the scope thereof.

Subject matter will now be described more fully herein after with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems/devices. Accordingly, embodiments may, for example, take the form of hardware, software, firmware or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms, such as "and", "or", or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a", "an", or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Additionally, the term "step" can be utilized interchangeably with "instruction" or "operation".

Unless defined otherwise, all technical and scientific terms used herein have the same meanings as commonly understood by one of ordinary skill in the art. As used in this document, the term "comprising" means "including, but not limited to."

Figure 9:
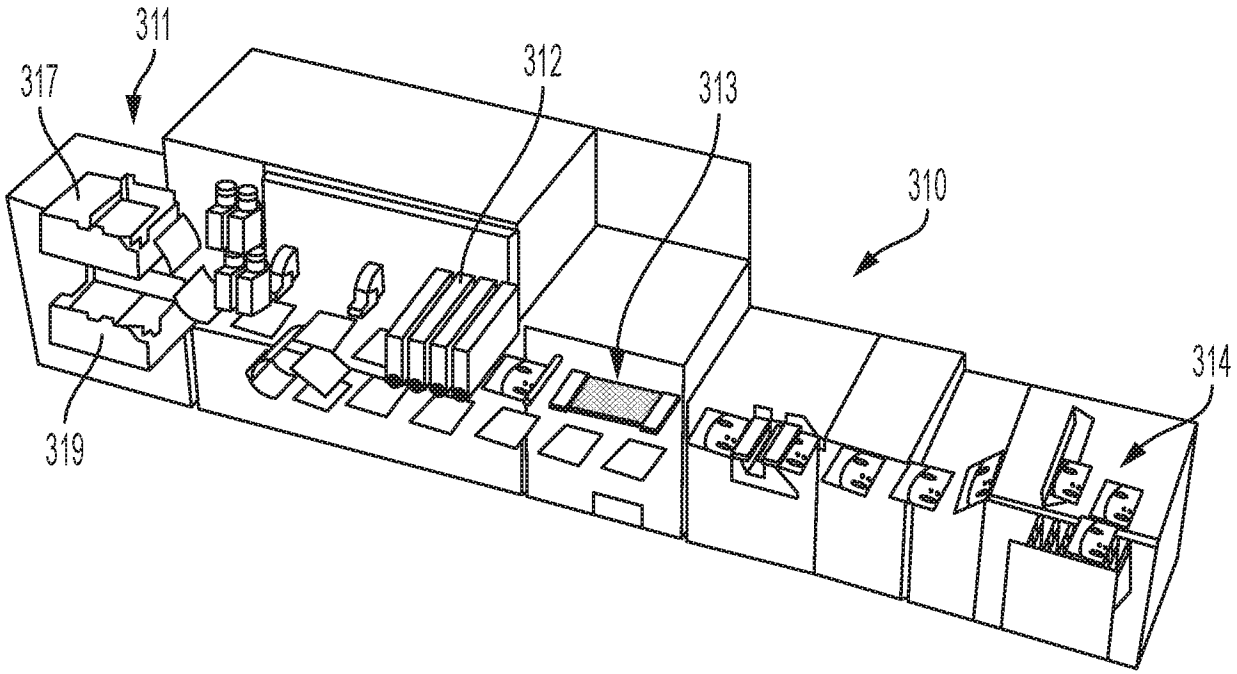
FIG. 9 illustrates a pictorial diagram depicting a printing system in which an embodiment may be implemented.

The term "printing system" as utilized herein can relate to a printer, including digital printing devices and systems that accept text and graphic output from a computing device, electronic device or data processing system and transfers the information to a substrate such as paper, usually to standard size sheets of paper. A printing system may vary in size, speed, sophistication, and cost. In general, more expensive printers are used for higher-resolution printing. A printing system can render images on print media, such as paper or other substrates, and can be a copier, a laser printer, a bookmaking machine, a facsimile machine, or a multifunction machine (which can include one or more functions such as scanning, printing, archiving, emailing, faxing and so on). An example of a printing system that can be adapted for use with one or more embodiments is shown in FIG. 9 and also in FIG. 12.

The term "transport belt" as utilized herein can relate to a belt implemented in a printing system in association in with a rotatable member such as a roller or other transport members or web transport configurations. Such a transport belt can relate to marking transport or marker transport, which may become contaminated with aqueous ink. To permit a high registration accuracy, a printing system can employ such a transport belt, which in some implementations can pass in front of toner cartridges and each of the toner layers can be precisely applied to the transport belt. The combined layers can be then applied to the paper in a uniform single step. It should be appreciated, however, that the disclosed embodiments are not limited to printers that utilize toner. Ink and other types of marking media may be utilized in other printing embodiments. That is, a printing system is not limited to a laser printing implementation but may be realized in other contexts, such as ink-jet printing systems.

Note that the terms "roller" and "roll" as utilized herein may refer to the same feature or component. In some cases, however, the term "roller" can include a "roll".

A "computing device" or "electronic device" or "data processing system" refers to a device or system that includes a processor and non-transitory, computer-readable memory. The memory may contain programming instructions that, when executed by the processor, cause the computing device to perform one or more operations according to the programming instructions. As used in this description, a "computing device" or "electronic device" may be a single device, or any number of devices having one or more processors that communicate with each other and share data and/or instructions. Examples of computing devices or electronic devices include, without limitation, personal computers, servers, mainframes, gaming systems, televisions, and portable electronic devices such as smartphones, personal digital assistants, cameras, tablet computers, laptop computers, media players and the like. Various elements of an example of a computing device or processor are described below with reference to FIGS. 10 and 11.

Figure 4:
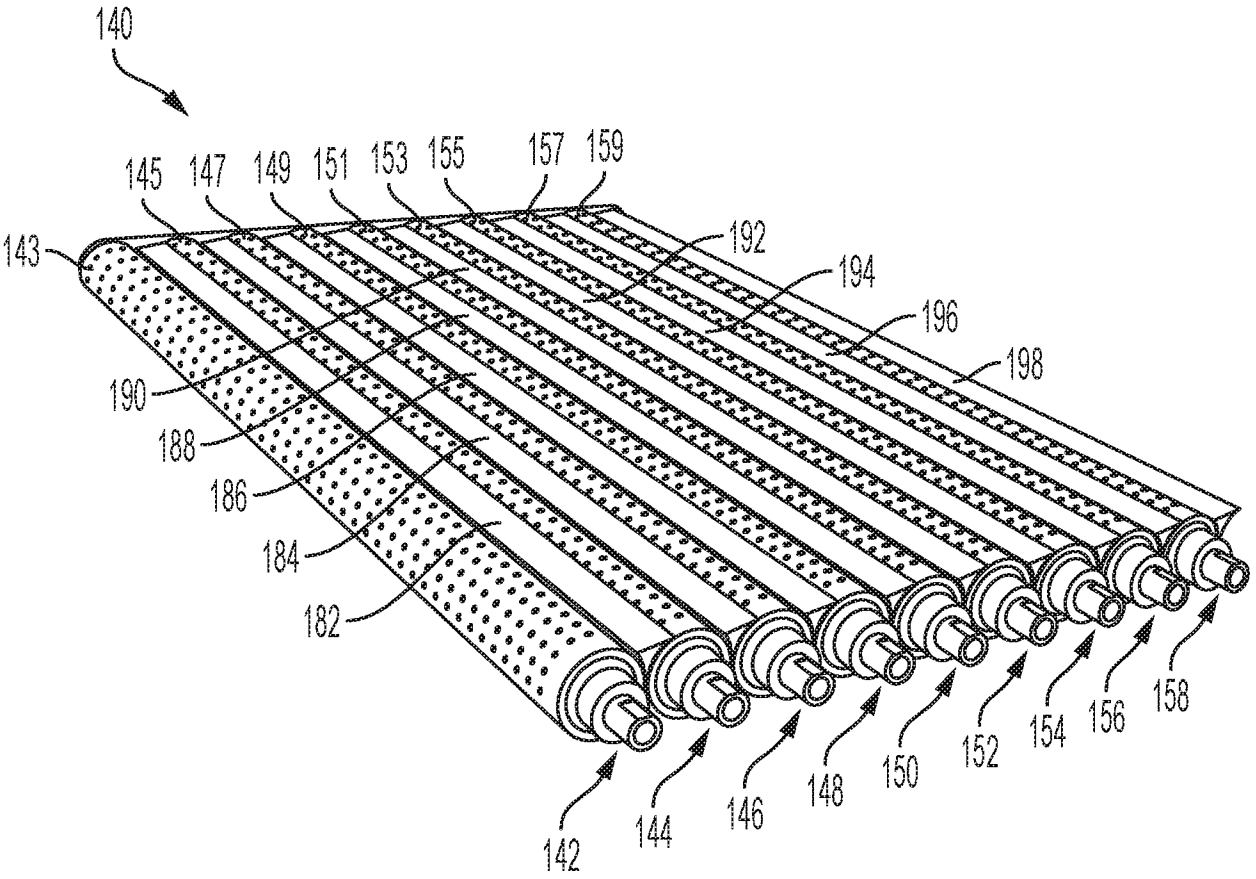
FIG. 4 illustrates a pictorial diagram depicting an operator side vacuum baffle roller system sub-assembly, in accordance with an embodiment.

FIG. 4 illustrates a pictorial diagram depicting an operator side vacuum baffle roller system sub-assembly 140 of a vacuum roller system, in accordance with an embodiment. The vacuum baffle roller system sub-assembly 140 shown in FIG. 4 can be implemented in the context of a printing system such as, for example, the printing system 310 shown in FIG. 9. The operator side vacuum baffle roller system sub-assembly 140 can include a plurality of vacuum rollers composed of a roller 143, a roller 145, a roller 147, a roller 149, a roller 151, a roller 153, a roller 155, a roller 157, and a roller 159. It should be appreciated that the number rollers implemented in the operator side vacuum baffle roller system sub-assembly 140 is not a limiting feature of the disclosed embodiments. Fewer or more rollers may be implemented, depending upon design considerations.

The plurality of vacuum rollers can move sheets of media through a dryer (e.g., a downstream dryer) in a printing system such as the aforementioned printing system 310. The vacuum rollers 143, 145, 147, 149, 151, 153, 155, 157, and 149 do not require a vacuum to be drawn between such vacuum rollers. As shown in FIG. 4, each of the rollers 143, 145, 147, 149, 151, 153, 155, 157, and 149 is configured with a plurality of vacuum holes.

Each vacuum roller can include a respective plenum operable to direct the vacuum to a top portion of the vacuum roller to drive a sheet from one roller to a next roller. The vacuum baffle roller system sub-assembly 140 can include an internal roller plenum system that can be axially located within a roller capable of directing the vacuum to a set of holes to transfer cut sheet media from roller to roller.

The plenum can engage vacuum holes in a rotating vacuum roller when the vacuum holes in the vacuum roller are aligned with the plenum. Thus, a plurality of plenums is shown in FIG. 4, including a plenum 182, a plenum 184, a plenum 186, a plenum 188, a plenum 190, a plenum 192, a plenum 194, a plenum 196, and a plenum 198. Each of the rollers 143, 145, 147, 149, 151, 153, 155, 157, and 149 surrounds a respective shaft portion that extend distally along the length of each of the respective rollers 143, 145, 147, 149, 151, 153, 155, 157, and 149.

Each shaft portion can connect to a respective shaft end portion such as a shaft end portion 142, a shaft end portion, a shaft end portion 144, a shaft end portion 146, a shaft end portion 148, a shaft end portion 150, a shaft end portion 152, a shaft end portion 154, a shaft end portion 156, and a shaft end portion 158. Thus, each roller can include a first shaft end portion and a second end portion that can be located distally and opposite from one another at the ends of the vacuum roller and at the ends of the shaft that the vacuum roller surrounds. That is, each vacuum roller can surround a respective shaft and each shaft can include first and second end portions located opposite one another.

Figure 5:
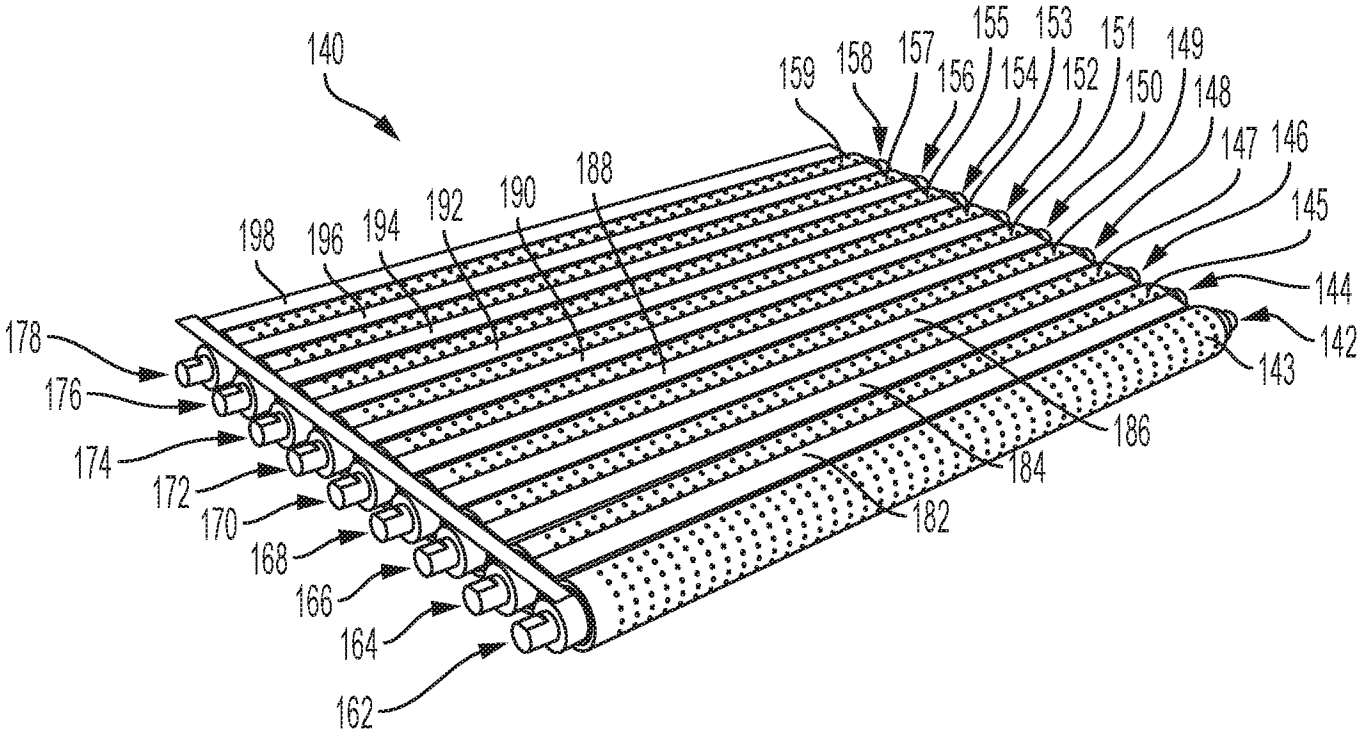
FIG. 5 illustrates a drive side view of the vacuum baffle roller system sub-assembly shown in FIG. 4, in accordance with an embodiment.

FIG. 5 illustrates a drive side view of the vacuum baffle roller system sub-assembly 140 shown in FIG. 4, in accordance with an embodiment. Thus, as shown in FIGS. 4-8, identical parts or elements are indicated by identical reference numerals. In addition to the shaft end portion 142, the shaft end portion, 144, the shaft end portion 146, the shaft end portion 148, the shaft end portion 150, the shaft end portion 152, the shaft end portion 154, the shaft end portion 156, and the shaft end portion 158, opposite and respective shaft end portions are also shown in FIG. 5. For example, a shaft end portion 162, a shaft end portion 164, a shaft end portion 166, a shaft end portion 168, a shaft end portion 170, a shaft end portion 172, a shaft end portion 174, a shaft end portion 176, and a shaft end portion 178 are shown in FIG. 5.

Figure 6:
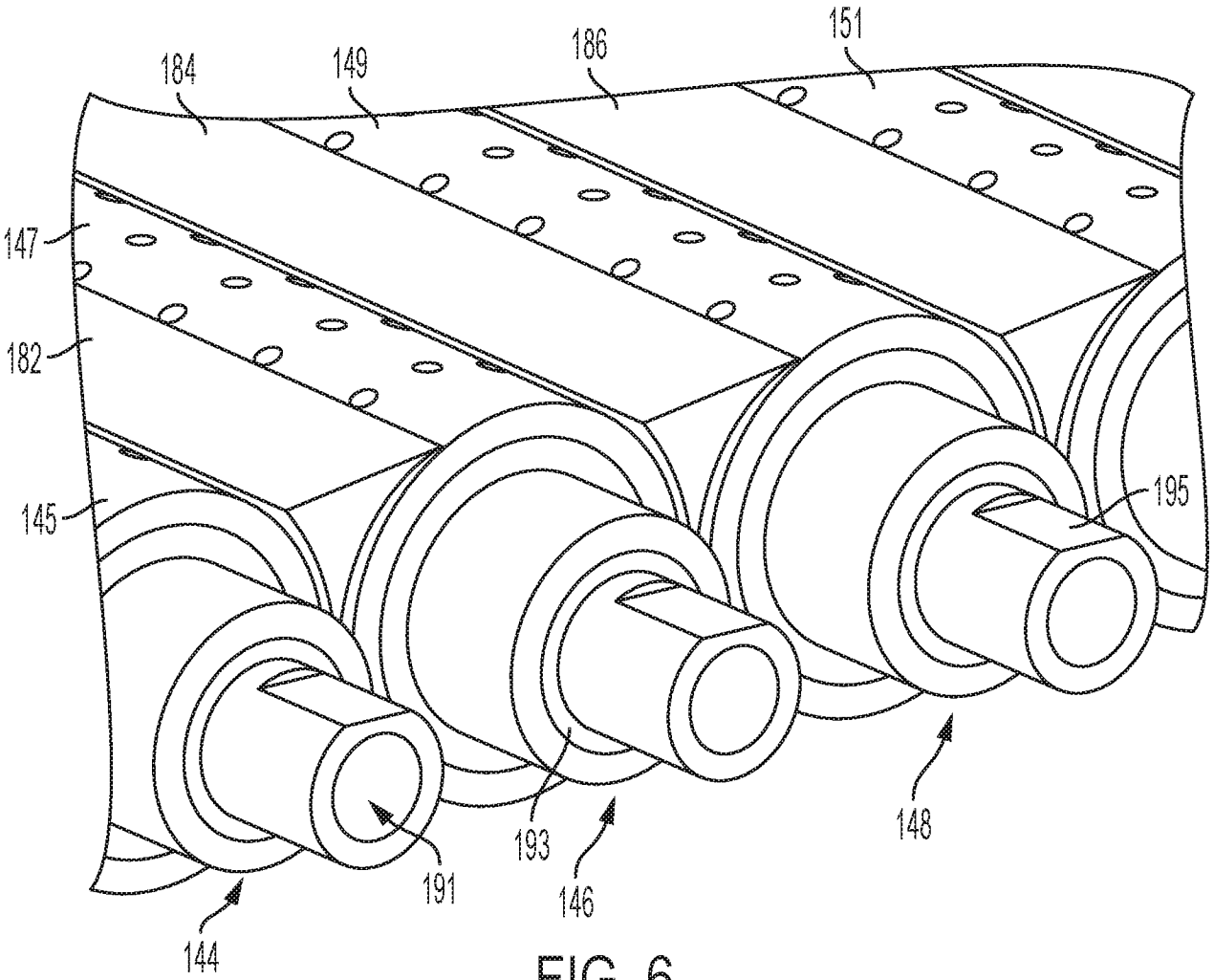
FIG. 6 illustrates a vacuum rolls close-up view of three rolls and a baffle, in accordance with an embodiment.

FIG. 6 illustrates a vacuum rolls close-up view of rollers 145, 147, 149, and 151 and a baffle, in accordance with an embodiment. Shaft end portions 144, 146, and 148 and are also shown in FIG. 6. Each shaft end portion 144, 146, and 148 can include or can be formed with a vacuum opening, a bushing, and a flat portion. For example, shaft end portion 144 includes a vacuum opening 191, the shaft end portion 146 includes a bushing 193, and the shaft end portion 148 includes a flat portion 195. The vacuum opening 191 provides an opening to a plenum through the center of shaft. That is, each roller surrounds a respective shaft and each shaft has a respect shaft end portions (which are distally opposite each other as discussed above). Each bushing, such as the bushing 193, can allow the outer roller to rotate around the fixed inner vacuum shaft. In addition, each flat portion, such as the flat portion 195, can be located on a flat area on the inner vacuum shaft to keep the shaft from rotating. In addition, such a flat portion can be used to control the optional rotation of the inner vacuum plenum.

Figure 7:
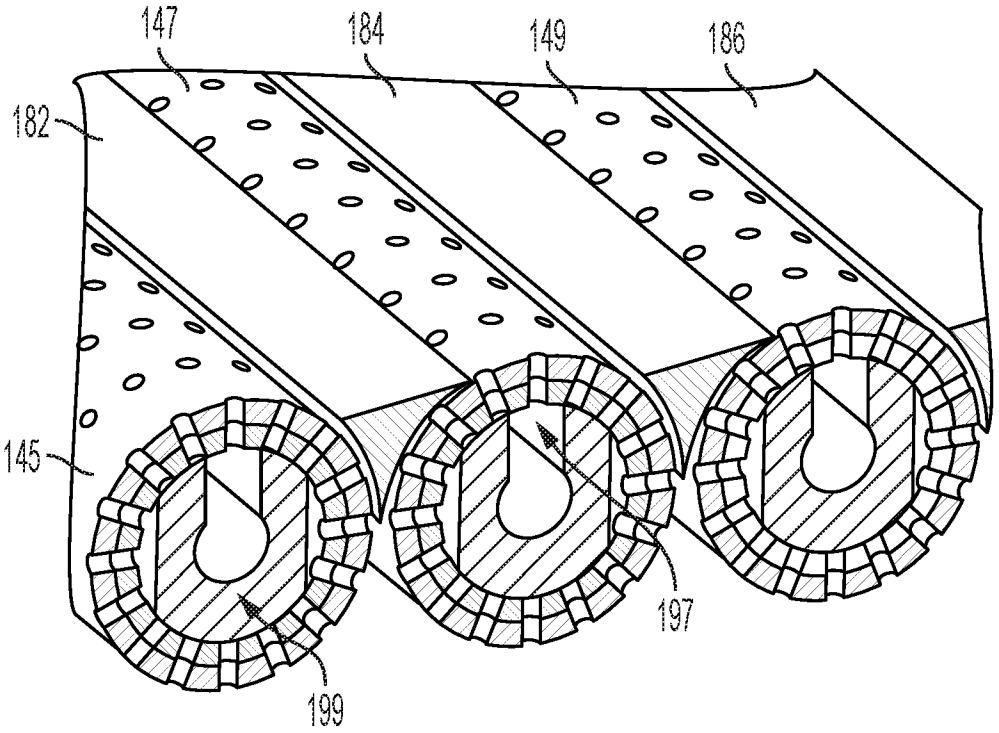
FIG. 7 illustrates a sectional view of vacuum rolls with an inner stationary vacuum plenum system, in accordance with an embodiment

FIG. 7 illustrates a sectional view of vacuum rollers with an inner stationary vacuum plenum system, in accordance with an embodiment. In FIG. 7, vacuum rollers 145, 147, and 149 are shown. The plenum 182 is disposed between the vacuum roller 145 and the vacuum roller 147. The plenum 184 is shown disposed between the vacuum roller 147 and the vacuum roller 149, and the plenum 186 is shown with respect to the roller 149. Each vacuum roller can include an inner stationary vacuum plenum system that can incorporate or can be formed with an inner plenum with a venting alignment at the top of roller. This inner plenum can remain in the position in which it is placed and the outer rollers can rotate around the inner plenum. An example of such an inner plenum is the inner plenum 199 shown in FIG. 7 with respect to the vacuum roller 145. Each vacuum roller can also include a respective vacuum plenum. An example of such a vacuum plenum is the vacuum plenum 197 shown in FIG. 7 with respect to the vacuum roller 147. The vacuum holes can be aligned with each vacuum plenum to provide drive at the top of each roller.

Figure 8:
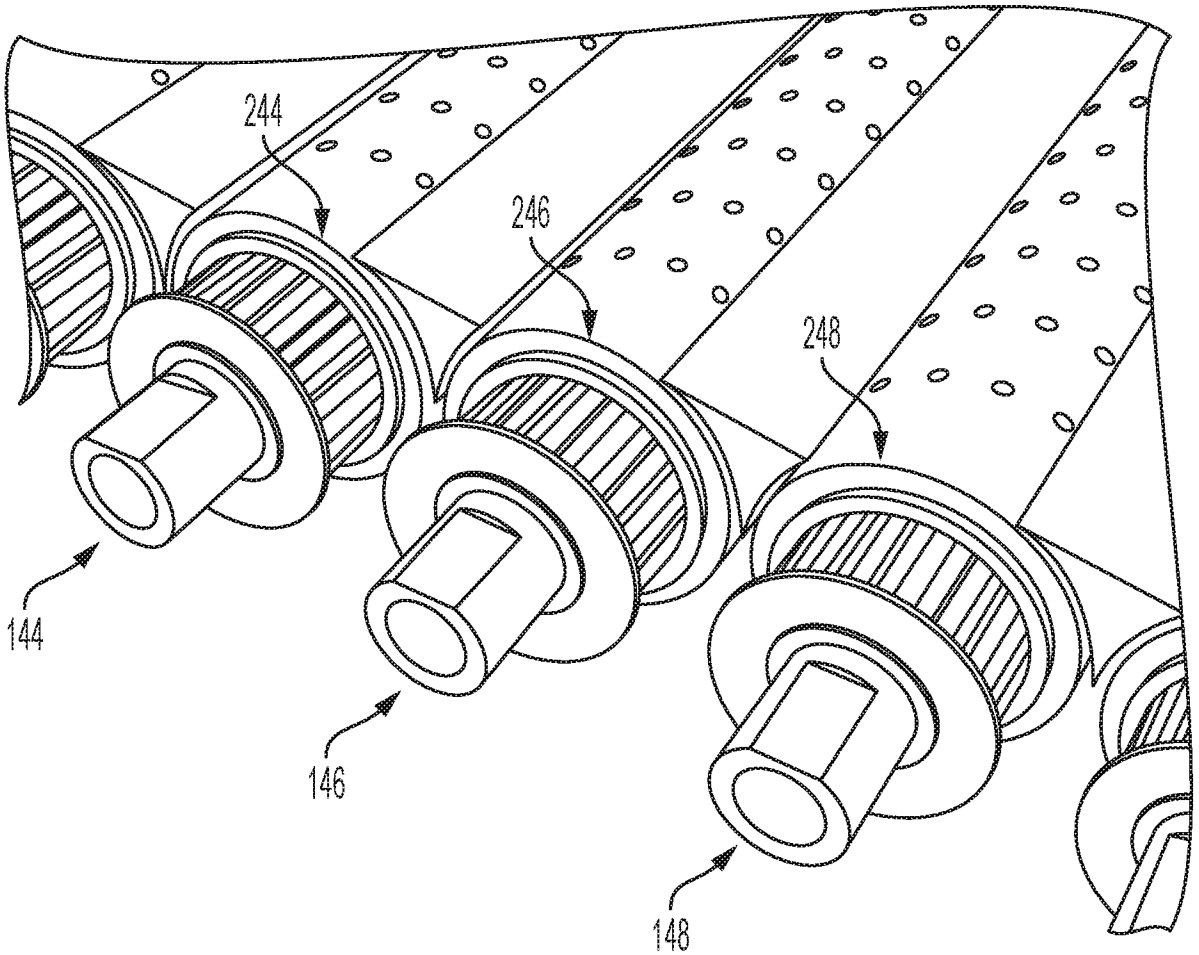
FIG. 8 illustrates a drive view of a vacuum roller system including a plurality of timing belt drive pulleys, in accordance with an embodiment.

FIG. 8 illustrates a drive view of a vacuum roller system including a plurality of timing belt drive pulleys, in accordance with an embodiment. In the example shown in FIG. 8, the shaft end portion 144 is associated with a timing belt pulley 244, the shaft end portion 146 is associated with a timing belt pulley 246, and the shaft end portion 148 is associated with a timing belt pulley 248.

The vacuum baffle roller system sub-assembly 140 and its components as shown in FIGS. 4-8 can provide for a drive system that can continually move a sheet through a dryer at a constant velocity while only contacting the sheet intermittently and limiting the time the sheet may be in contact with any particular part of the drive system. The vacuum baffle roller system sub-assembly 140 can also make use of vacuum, but again the vacuum may only be applied to each roller for a portion of the time the media is in contact with each roller.

The vacuum can be applied through each roller and only at the point of contact to provide drive. This is important because using a roller system that applies vacuum either between the rollers or further around the roller may lead to lighter weights or media with down curl being driven into a downstream roller. Often, as shown here, the rollers may have a lower udometer silicone drive surface that can lead to stubbing if the sheets are directed at too steep an angle into a downstream roller.

In addition by controlling the air more closely with the linear plenum within the roller, less air may be required to provide the necessary drive. A benefit of this system is the ability to transport the sheet without having continual contact between a belt/belt hole surface and the back of the media. Because the roller rotates around the plenum, which acts as the axis of rotation as well, the plenum can remain located in position to provide the vacuum at the top portion of the roller. The plenum angle can be adjustable for differing media needs by separately rotating the plenum within the roller to align the plenum and the roller holes if media handling changes are required. This can be accomplished either manually or through feedback controls.

FIG. 9 illustrates a pictorial diagram depicting an example printing system 310 in which an embodiment may be implemented. In some embodiments, the printing system 310 can be implemented as an aqueous inkjet printer. The printing system 310 can include an internal vacuum plenum roller system, as disclosed herein. The printing system 310 can also include a number of sections or modules, such as, for example, a sheet feed module 311, a print head and ink assembly module 312, a dryer module 313 and a production stacker 314. The sheet feed module 311 can include a module 317 that maintains or stores sheets or media. The sheet feed module 311 can also include another module 319 that can maintain or store sheets of media. Such modules can be composed of physical hardware components, but in some cases may include the use of software or may be subject to software instructions, steps or operations.

It should be appreciated that the printing system 310 depicted in FIG. 9 represents one example of an aqueous inkjet printer that can be adapted for use with one or more embodiments. The particular configuration and features shown in FIG. 9 should not be considered limiting features of the disclosed embodiments. That is, other types of printers can be implemented in accordance with different embodiments. For example, the printing system 310 can be configured as a printer that uses water-based inks or solvent-based inks, or in some cases may utilize toner ink in the context of a LaserJet printing embodiment.

In an embodiment, the sheet feed module 311 of the printing system 310 can be configured to hold, for example, 2,500 sheets of 90 gsm, 4.0 caliper stock in each of two trays. With 5,000 sheets per unit and up to 4 possible feeders in such a configuration, 20,000 sheets of non-stop production activity can be facilitated by the printing system 310. The sheet feed module can include an upper tray 17 that holds, for example, paper sizes 8.27"×10"/210 mm×254 mm to 14.33"×20.5"/364 mm×521 mm, while a lower tray 19 can hold paper sizes ranging from, for example, 7"×10"/178 mm×254 mm to 14.33"×20.5"/364 mm×521 mm. Each feeder can utilize a shuttle vacuum feed head to pick a sheet of media off the top of the stack and deliver it to a transport mechanism.

In an embodiment, the print head and ink assembly module 312 of the printing system 310 can include a plurality of inkjet print heads that can be configured to deliver four different drop sizes through, for example, 7,870 nozzles per color to produce prints with, for example, a 600×600 dpi. An integrated full-width scanner can enable automated print head adjustments, missing jet correction and image-on-paper registration. Operators can make image quality improvements for special jobs such as edge enhancement, trapping, and black overprint. At all times automated checks and preventative measures can maintain the press in a ready state and operational.

The dryer module 313 of the printing system 310 can include a dryer. After printing, the sheets of media can move directly into a dryer where the paper and ink are heated with seven infrared carbon lamps to about 90° C. (194° F.). This process can remove moisture from the paper so that the sheets of media are sufficiently stiff to move efficiently through the paper path. The drying process can also remove moisture from the ink to prevent it from rubbing off. A combination of sensors, thermostats, thermistors, thermopiles, and blowers can accurately heat these fast-moving sheets of media, and can maintain a rated print speed.

The production stacker 314 can include a finisher that can run continuously as it delivers up to, for example, 2,850 sheets of media at a time. Once unloaded, the stack tray can return to the main stack cavity to pick and deliver another load—continuously. The stacker 114 can provide an adjustable waist-height for unloading from, for example, 8" to 24", and a by-pass path with the ability to rotate sheets to downstream devices. The production stacker 14 can also be configured with, for example, a 250-sheet top tray for sheet purge and samples, and can further include an optional production media cart to ease stack transport. One non-limiting example of printing system 310 is the Xerox® Brenva® HD Production Inkjet Press, a printing product of Xerox Corporation. The printing system can include transport members including the transport belts discussed herein and/or other features including for example a Brenva®/Fervent® marking transport, which is also a product of Xerox Corporation.

As can be appreciated by one skilled in the art, embodiments can be implemented in the context of a method, data processing system, or computer program product. Accordingly, embodiments may take the form of an entirely hardware embodiment, an entirely software embodiment or an embodiment combining software and hardware aspects all generally referred to herein as a "circuit" or "module." Furthermore, embodiments may in some cases take the form of a computer program product on a computer-usable storage medium having computer-usable program code embodied in the medium. Any suitable computer readable medium may be utilized including hard disks, USB Flash Drives, DVDs, CD-ROMs, optical storage devices, magnetic storage devices, server storage, databases, etc.

Computer program code for carrying out operations of the present invention may be written in an object oriented programming language (e.g., Java, C++, etc.). The computer program code, however, for carrying out operations of particular embodiments may also be written in procedural programming languages or in a visually oriented programming environment.

The program code may execute entirely on a user's computer, partly on a user's computer, as a stand-alone software package, partly on a user's computer and partly on a remote computer or entirely on the remote computer. In the latter scenario, the remote computer may be connected to a user's computer through a bidirectional data communications network (e.g., a local area network (LAN), wide area network (WAN), wireless data network, a cellular network, etc.) or the bidirectional connection may be made to an external computer via most third party supported networks (e.g., through the Internet utilizing an Internet Service Provider).

The embodiments are described at least in part herein with reference to flowchart illustrations and/or block diagrams of methods, systems, and computer program products and data structures according to embodiments of the invention. It will be understood that each block of the illustrations, and combinations of blocks, can be implemented by computer program instructions. These computer program instructions may be provided to a processor of, for example, a general-purpose computer, special-purpose computer, or other programmable data processing apparatus to produce a machine, such that the instructions, which execute via the processor of the computer or other programmable data processing apparatus, create means for implementing the functions/acts specified in the block or blocks. To be clear, the disclosed embodiments can be implemented in the context of, for example a special-purpose computer or a general-purpose computer, or another programmable data processing apparatus or system. For example, in some embodiments, a data processing apparatus or system can be implemented as a combination of a special-purpose computer and a general-purpose computer.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the various block or blocks, flowcharts, and other architecture illustrated and described herein.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 10:
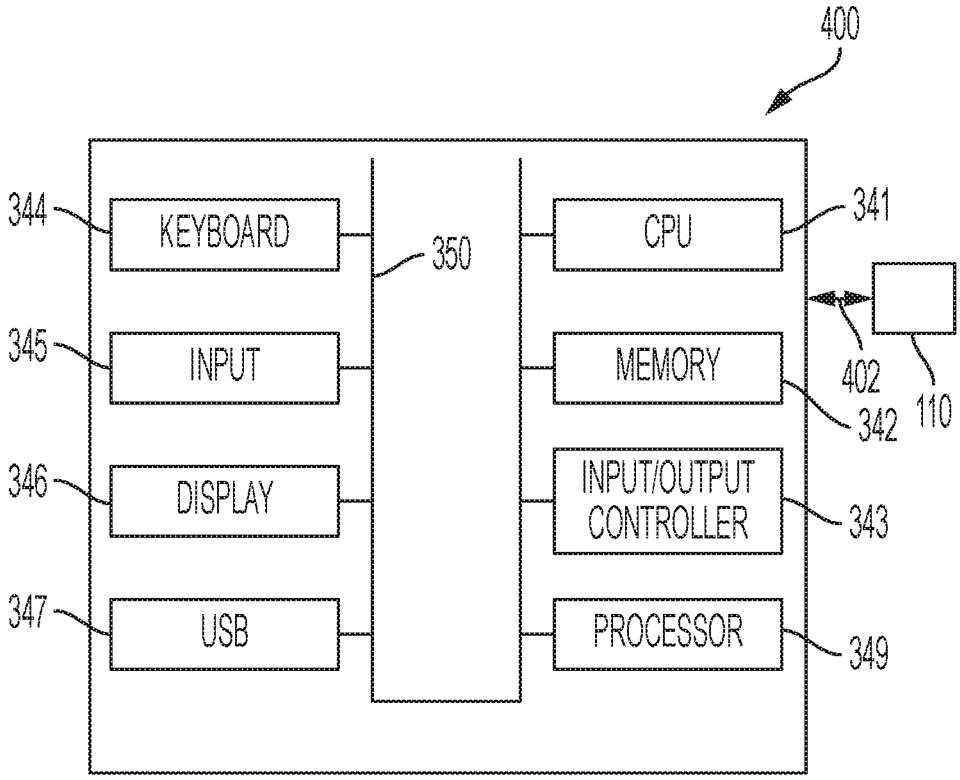
FIG. 10 illustrates a schematic view of a computer system, in accordance with an embodiment.
Figure 11:
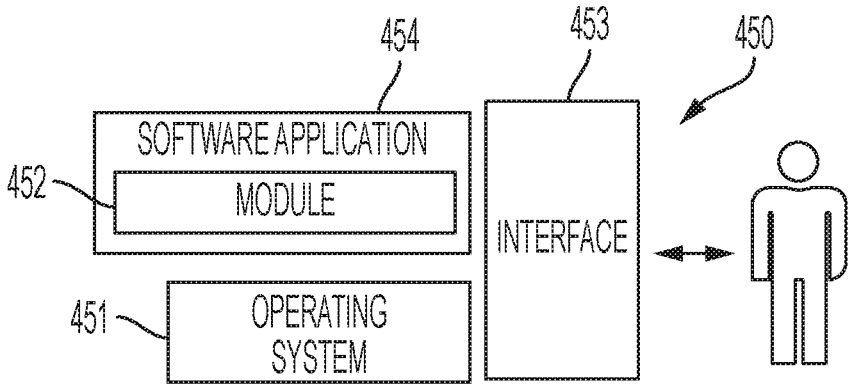
FIG. 11 illustrates a schematic view of a software system including a module, an operating system, and a user interface, in accordance with an embodiment.

FIGS. 10-11 are shown only as exemplary diagrams of data-processing environments in which example embodiments may be implemented. It should be appreciated that FIGS. 10-11 are only exemplary and are not intended to assert or imply any limitation with regard to the environments in which aspects or embodiments may be implemented. Many modifications to the depicted environments may be made without departing from the spirit and scope of the disclosed embodiments.

As illustrated in FIG. 10, some embodiments may be implemented in the context of a data-processing system 400 that can include, for example, one or more processors including a CPU (Central Processing Unit) 341 and/or other another processor 349 (e.g., microprocessor, microcontroller etc.), a memory 342, an input/output controller 343, a peripheral USB (Universal Serial Bus) connection 347, a keyboard 344 and/or another input device 345 (e.g., a pointing device such as a mouse, trackball, pen device, etc.), a display 346 (e.g., a monitor, touch screen display, etc.) and/or other peripheral connections and components. FIG. 10 is an example of a computing device that can be adapted for use in accordance with one possible embodiment.

As illustrated, the various components of the data-processing system 400 can communicate electronically through a system bus 351 or similar architecture. The system bus 351 may be, for example, a subsystem that transfers data between, for example, computer components within data-processing system 400 or to and from other data-processing devices, components, computers, etc. The data-processing system 400 may be implemented in some embodiments as, for example, a server in a client-server based network (e.g., the Internet) or in the context of a client and a server (i.e., where aspects are practiced on the client and the server).

In some example embodiments, the data-processing system 400 may be, for example, a standalone desktop computer, a laptop computer, a Smartphone, a pad computing device, a networked computer server, and so on, wherein each such device can be operably connected to and/or in communication with a client-server based network or other types of networks (e.g., cellular networks, Wi-Fi, etc.). The data-processing system 400 can communicate with other devices or systems (e.g., the printing system 310). Communication between the data-processing system 400 and the printing system 310 can be bidirectional, as indicated by the double arrow 402. Such bidirectional communications may be facilitated by, for example, a computer network, including wireless bidirectional data communications networks.

FIG. 11 illustrates a computer software system 450 for directing the operation of the data-processing system 400 depicted in FIG. 10. Software application 454, stored for example in the memory 342 can generally include one or more modules, an example of which is module 452. The computer software system 450 also can include a kernel or operating system 451 and a shell or interface 453. One or more application programs, such as software application 454, may be "loaded" (i.e., transferred from, for example, mass storage or another memory location into the memory 342) for execution by the data-processing system 400. The data-processing system 400 can receive user commands and data through the interface 453; these inputs may then be acted upon by the data-processing system 400 in accordance with instructions from operating system 451 and/or software application 454. The interface 453 in some embodiments can serve to display results, whereupon a user 459 may supply additional inputs or can terminate a session. The software application 454 can include module(s) 452, which can, for example, implement instructions or operations such as those discussed herein. Module 452 may also be composed of a group of modules and/or sub-modules.

The following discussion is intended to provide a brief, general description of suitable computing environments in which the system and method may be implemented. Although not required, the disclosed embodiments will be described in the general context of computer-executable instructions, such as program modules, being executed by a single computer. In most instances, a "module" can constitute a software application, but can also be implemented as both software and hardware (i.e., a combination of software and hardware).

Generally, program modules include, but are not limited to, routines, subroutines, software applications, programs, objects, components, data structures, etc., that perform particular tasks or implement particular data types and instructions. Moreover, those skilled in the art will appreciate that the disclosed method and system may be practiced with other computer system configurations, such as, for example, hand-held devices, multi-processor systems, data networks, microprocessor-based or programmable consumer electronics, networked PCs, minicomputers, mainframe computers, servers, and the like.

Note that the term module as utilized herein may refer to a collection of routines and data structures that perform a particular task or implements a particular data type. A module may be composed of two parts: an interface, which lists the constants, data types, variable, and routines that can be accessed by other modules or routines, and an implementation, which may be private (e.g., accessible only to that module) and which can include source code that actually implements the routines in the module. The term module can also refer to an application, such as a computer program designed to assist in the performance of a specific task, such as word processing, accounting, inventory management, etc. A module may also refer to a physical hardware component or a combination of hardware and software. The previously discussed dryer module 113 is an example of a physical hardware component that can also operate according to instructions provided by a module such as module 452.

The module 452 may include instructions (e.g., steps or operations) for performing operations such as those discussed herein. For example, module 452 may include instructions for operating a vacuum roller system such as the vacuum roller discussed herein, including the operator side vacuum baffle roller system sub-assembly 140, in the context of a printing system such as the printing system 310.

Examples of steps, operations or instructions for implementing a method of operating a vacuum roller system can include: moving a sheet of media through a dryer with a plurality of vacuum rollers, wherein the vacuum rollers in the plurality of vacuum rollers do not require a vacuum to be drawn between the vacuum rollers; and directing the vacuum to a top portion of the vacuum roller with a plenum to drive the sheet of media from one roller to a next roller among the plurality of vacuum rollers, wherein each vacuum roller among the plurality of vacuum rollers comprises a plenum operable to direct the vacuum to the top portion of the vacuum roller to drive the sheet of media from the one roller to the next roller among the plurality of vacuum rollers, wherein the plenum engages vacuum holes in a rotating vacuum roller when the vacuum holes in the vacuum roller are aligned with the plenum. Other instructions can include, for example, instructions for rotating the vacuum rollers about a fixed stationary plenum with a single drive system, instructions for adjusting the plenum to allow for variations of an application of the vacuum to the sheet and wherein an angle of the plenum is adjustable to move an acquisition point of the vacuum to the sheet of media, and instructions for adjusting an angle of the plenum based on printing job data including at least one of: a weight of the sheet of media, a size of the sheet of media and a coating, wherein the printing job data is entered by an operator of the printing system or comprises printing job data previously saved in the printing system.

Figure 12:
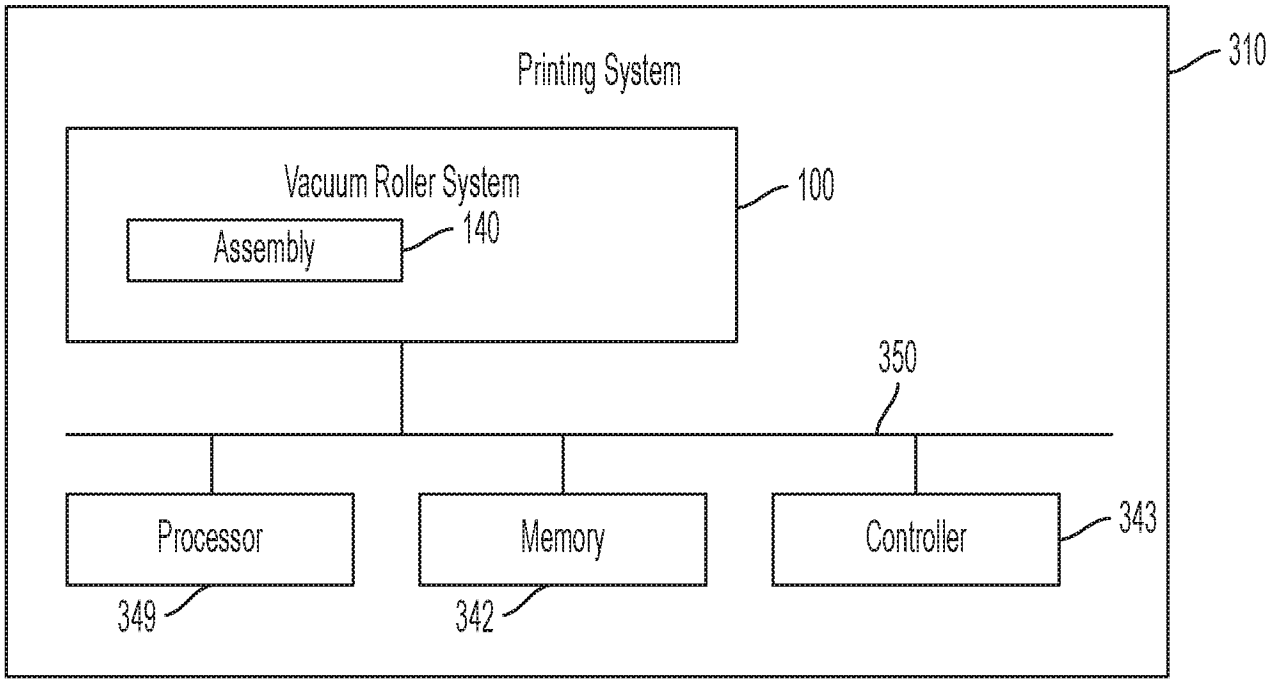
FIG. 12 illustrates a block diagram depicting a printing system, which can include a vacuum roller system that includes the operator side vacuum baffle roller system sub-assembly, in accordance with an embodiment.

FIG. 12 illustrates a block diagram depicting the printing system 310, which can include a vacuum roller system 100 that includes the aforementioned operator side vacuum baffle roller system sub-assembly 140, in accordance with an embodiment. The printing system 310 shown in FIG. 12 is an alternative version of the embodiment shown in FIG. 9, and may include, for example, the processor 349, the memory 342, and the controller 343, which together may operate the vacuum roller system 100 including the operator side vacuum baffle roller system sub-assembly 140. Alternatively, the printing system 310 may simply communicate with a data-processing system such as the data-processing system 400 to operate the vacuum roller system 100 and the operator side vacuum baffle roller system sub-assembly 140.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A vacuum roller system, comprising:

a plurality of vacuum rollers that moves a sheet of media through a dryer, wherein the vacuum rollers in the plurality of vacuum rollers do not require a vacuum to be drawn between the vacuum rollers; and wherein each vacuum roller among the plurality of vacuum rollers comprises a plenum among a plurality of plenums operable to direct the vacuum to a top portion of the vacuum roller to drive the sheet of media from one vacuum roller to a next vacuum roller among the plurality of vacuum rollers, wherein the plenum engages vacuum holes in the vacuum roller that rotates among the plurality of vacuum roller when the vacuum holes in the vacuum roller are aligned with the plenum;

wherein the each vacuum roller includes an inner stationary vacuum plenum system and a first shaft end portion and a second shaft end portion; and wherein each of the first and second shaft end portions of the each vacuum roller includes a vacuum shaft, a bushing, and a flat portion, wherein a vacuum opening is located with respect to the plenum through a center of the vacuum shaft, the bushing is operable to allow the vacuum roller to rotate around the vacuum shaft, and the flat portion is used to prevent the vacuum shaft from rotating, and for controlling an optional rotation of the vacuum plenum among the plurality of plenums.

2. The vacuum roller system of claim 1 wherein the dryer comprises a downstream dryer of a printing system.

3. The vacuum roller system of claim 2 wherein:

an angle of the plenum is adjustable based on printing job data including at least one of: a weight of the sheet of media, a size of the sheet of media and a coating; and the printing job data is entered by an operator of the printing system or comprises printing job data previously saved in the printing system.

4. The vacuum roller system of claim 1 further comprising a single drive system that rotates the each vacuum roller among the plurality of vacuum rollers about the plenum wherein the plenum comprises a fixed stationary plenum.

5. The vacuum roller system of claim 4 wherein the single drive system comprises a timing belt.

6. The vacuum roller system of claim 1 further comprising a plurality of timing belt pulleys wherein a shaft end portion is associated with at least one timing belt pulley among the plurality of timing belt pulleys and wherein another shaft portion is associated with at least one other timing belt pulley among the plurality of timing belt pulleys.

7. The vacuum roller system of claim 6 wherein an angle of the plenum is adjustable to move an acquisition point of the vacuum to the sheet of media.

8. The vacuum roller system of claim 1 further comprising an operator side vacuum baffle roller system sub-assembly that includes the plurality of vacuum rollers.

9. The vacuum roller system of claim 8 wherein the operator side vacuum baffle roller system sub-assembly includes the plurality of plenums comprising a roller plenum system axially located within a vacuum roller and operable to direct the vacuum to a set of holes including the vacuum holes to transfer cut sheet media comprising the sheet of media from vacuum roller to vacuum roller among the plurality of vacuum rollers.

10. A vacuum roller system, comprising:

at least one processor; and a non-transitory computer-usable medium embodying computer program code, the computer-usable medium capable of communicating with the at least one processor, the computer program code comprising instructions executable by the at least one processor and configured for:

moving a sheet of media through a dryer with a plurality of vacuum rollers, wherein the vacuum rollers in the plurality of vacuum rollers do not require a vacuum to be drawn between the vacuum rollers; and directing the vacuum to a top portion of the vacuum roller with a plenum among a plurality of plenums to drive the sheet of media from one vacuum roller to a next vacuum roller among the plurality of vacuum rollers, wherein each vacuum roller among the plurality of vacuum rollers comprises a plenum operable to direct the vacuum to the top portion of the vacuum roller to drive the sheet of media from the one roller to the next roller among the plurality of vacuum rollers, wherein the plenum engages vacuum holes in the vacuum roller that rotates among the plurality of vacuum roller when the vacuum holes in the vacuum roller are aligned with the plenum; and adjusting an angle of the plenum based on printing job data including a weight of the sheet of media, a size of the sheet of media and a coating, wherein the printing job data is entered by an operator of the printing system or comprises printing job data previously saved in the printing system.

11. The vacuum roller system of claim 10 further comprising a plurality of timing belt pulleys wherein a shaft end portion is associated with at least one timing belt pulley among the plurality of timing belt pulleys and wherein another shaft portion is associated with at least one other timing belt pulley among the plurality of timing belt pulleys and wherein an angle of the plenum is adjustable to move an acquisition point of the vacuum to the sheet of media.

12. The vacuum roller system of claim 10 further comprising an operator side vacuum baffle roller system sub-assembly that includes the plurality of vacuum rollers.

13. The vacuum roller system of claim 10 wherein the operator side vacuum baffle roller system sub-assembly includes a roller plenum system axially located within a vacuum roller and operable to direct the vacuum to a set of holes to transfer cut sheet media from vacuum roller to vacuum roller among the plurality of vacuum rollers.

14. A method of operating a vacuum roller system, comprising:

moving a sheet of media through a dryer with a plurality of vacuum rollers, wherein the vacuum rollers in the plurality of vacuum rollers do not require a vacuum to be drawn between the vacuum rollers; and directing the vacuum to a top portion of the vacuum roller with a plenum to drive the sheet of media from one vacuum roller to a next vacuum roller among the plurality of vacuum rollers, wherein each vacuum roller among the plurality of vacuum rollers comprises a plenum among a plurality of plenums operable to direct the vacuum to the top portion of the vacuum roller to drive the sheet of media from the one roller to the next roller among the plurality of vacuum rollers, wherein the plenum engages vacuum holes in the vacuum roller that rotates among the plurality of vacuum roller when the vacuum holes in the vacuum roller are aligned with the plenum; and adjusting an angle of the plenum based on printing job data including a weight of the sheet of media, a size of the sheet of media and a coating, wherein the printing job data is entered by an operator of the printing system or comprises printing job data previously saved in the printing system.

15. The method of claim 14 wherein the dryer comprises a downstream dryer of a printing system.

16. The method of claim 14 further comprising rotating the vacuum rollers about a fixed stationary plenum with a single drive system.

17. The method of claim 16 wherein a shaft end portion is associated with at least one timing belt pulley among a plurality of timing belt pulleys and wherein another shaft portion is associated with at least one other timing belt pulley among the plurality of timing belt pulleys.

* * * * *